US010308019B2

(12) United States Patent
Takeyama et al.

(10) Patent No.: US 10,308,019 B2
(45) Date of Patent: Jun. 4, 2019

(54) CHARGE CONTROL-TYPE INKJET PRINTER AND PRINTING METHOD USING SAME

(71) Applicant: Hitachi Industrial Equipment Systems Co., Ltd., Chiyoda-ku, Tokyo (JP)

(72) Inventors: Hiromichi Takeyama, Tokyo (JP); Masahiko Ogino, Tokyo (JP); Keisuke Nagai, Tokyo (JP); Takashi Sato, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 15/766,354

(22) PCT Filed: Sep. 26, 2016

(86) PCT No.: PCT/JP2016/078152
§ 371 (c)(1),
(2) Date: Apr. 5, 2018

(87) PCT Pub. No.: WO2017/061287
PCT Pub. Date: Apr. 13, 2017

(65) Prior Publication Data

US 2018/0281401 A1 Oct. 4, 2018

(30) Foreign Application Priority Data

Oct. 8, 2015 (JP) ..... 2015-200090

(51) Int. Cl.
*B41J 2/08* (2006.01)
*B41J 2/01* (2006.01)
*B41J 2/025* (2006.01)

(52) U.S. Cl.
CPC . *B41J 2/08* (2013.01); *B41J 2/01* (2013.01); *B41J 2/025* (2013.01)

(58) Field of Classification Search
CPC combination set(s) only.
See application file for complete search history.

(56) References Cited

U.S. PATENT DOCUMENTS

2002/0089561 A1 7/2002 Weitzel et al.
2008/0309705 A1* 12/2008 Ito ..... B41J 2/0451 347/19
2010/0045731 A1* 2/2010 Kim ..... B41J 2/04561 347/19

FOREIGN PATENT DOCUMENTS

JP 2005-22222 A 1/2005
JP 2010-12710 A 1/2010
(Continued)

OTHER PUBLICATIONS

Japanese-language International Search Report (PCT/ISA/210) issued in PCT Application No. PCT/JP2016/078152 with English translation dated Nov. 29, 2016 (four (4) pages).
(Continued)

*Primary Examiner* — Huan H Tran
(74) *Attorney, Agent, or Firm* — Crowell & Moring LLP

(57) ABSTRACT

The present invention addresses the problem of enabling a charge control-type inkjet printer to enable real-time control during an operation and to maintain optimal printing conditions while operating. This charge control-type inkjet printer is provided with: a printing head including a nozzle unit for discharging ink; a pressure reduction valve for adjusting the pressure of the ink to be supplied to the nozzle unit of the printing head; and an ink container for accommodating the ink to be supplied to the nozzle unit of the printing head, wherein an imaging unit is further provided which images an image of ink that is discharged from the nozzle unit and is in a particulate state.

12 Claims, 5 Drawing Sheets

(56) References Cited

FOREIGN PATENT DOCUMENTS

| | | | |
|---|---|---|---|
| JP | 2010-17981 | A | 1/2010 |
| JP | 2011-173316 | A | 9/2011 |
| WO | WO 02/40273 | A2 | 5/2002 |

OTHER PUBLICATIONS

Japanese-language Written Opinion (PCT/ISA/237) issued in PCT Application No. PCT/JP2016/078152 dated Nov. 29, 2016 (four (4) pages).

* cited by examiner

801

| PATTERN SHAPE | PRESSURE REDUCTION VALVE (INK PRESSURE) | EXCITATION VOLTAGE | EXCITATION FREQUENCY | INK VISCOSITY (INK VISCOSITY ADJUSTMENT MECHANISM) |
|---|---|---|---|---|
| A | | | | |
| B | | | | |
| C | | | | |
| D | | | | |
| ... | | | | |

F I G. 9

901

| X+Y | X/Y | PRESSURE REDUCTION VALVE | EXCITATION VOLTAGE | EXCITATION FREQUENCY | INK VISCOSITY (INK VISCOSITY ADJUSTMENT MECHANISM) |
|---|---|---|---|---|---|
| +0.3 | 1.5<br>1.0<br>0.5 | | | | |
| +0.2 | 1.5<br>1.0<br>0.5 | | | | |
| +0.1 | 1.5<br>1.0<br>0.5 | | | | |
| 0 | 1.5<br>1.0<br>0.5 | | | | |
| −0.1 | 1.5<br>1.0<br>0.5 | | | | |
| ⋮ | ⋮ | | | | |

CHARGE CONTROL-TYPE INKJET PRINTER AND PRINTING METHOD USING SAME

TECHNICAL FIELD

The present invention relates to an inkjet printer that performs printing by charging ink particles, and a printing method using the same, and more particularly to a charge control-type inkjet printer having a function of controlling the charging of ink particles and a printing method using the same.

BACKGROUND ART

Regarding the charge control-type inkjet printer related to the present invention, the abstract of Patent Document 1 describes, as a solution for easily determining an optimal nozzle driving electric voltage for forming ink particles without skill, "the controlling unit does not energize a deflection electrode until the ink particles enter a gutter after giving an electric charge to the ink particles from an electrically charged electrode, arbitrarily set a plurality of times of nozzle driving electric voltages, and gives an electrical charge to the ink particles by an optional electrically charged electric voltage. The amount of the electric charge given to the ink particles is detected by a sensor for the amount of the electric charge, and when the electrically charged electric voltage is proportional to the amount of the electric charge of the ink particles, it is determined to be normal, and the central value of the nozzle driving electric voltage within a range where it is determined to be normal is set as the nozzle driving voltage used for printing."

CITATION LIST

Patent Document

Patent Document 1: JP 2010-17981 A

SUMMARY OF THE INVENTION

Problems to be Solved by the Invention

As an example of an inkjet printer, there is a charge control-type inkjet printer as described in Patent Document 1, which is a device for printing a manufacturing number, an expiration date and the like on a product to be printed.

Hereinafter, an operation principle of the charge control-type inkjet printer will be described based on the configuration described in FIG. 1 of Patent Document 1.

In the configuration described in FIG. 1 of Patent Document 1, the ink filled in a main body is pressurized by a pump and pressure-fed to a printing head. The ink pressure-fed to a nozzle in the printing head is vibrated by vibration of several ten kilohertz by a piezoelectric element 23 in the nozzle. An ink flow (inkjet) spouted from a discharge port of several ten microns of the nozzle is regularly cut by surface tension and vibration of the ink to be granulated (formed into droplet).

Since the ink particles (droplet) are cut from the ink flow in a charged state during the granulation, the ink particles are charged according to a size of a character. The charged ink particles are subjected to electrostatic force by a deflection electrode during flight and are deflected. The deflected ink particles adhere to a printed matter moving with respect to the printing head to form a character (a matrix character).

The ink for the charge control-type inkjet printer is basically formed of a coloring agent, a resin, a conductive agent, an additive, and a solvent. The ink is vibrated by ultrasonic vibration, spouted in an ink column shape from the discharge port, and granulated while being charged, whereby the ink flies as the ink particles. At this time, the charged state of the ink particles varies depending on how the ink column and the ink particles are cut off. When the charging state is not good, the particles may not be charged sufficiently with a designated amount of charge. Therefore, an accurate printing cannot be performed.

In order to obtain an optimal ink particle state, selection of the aforementioned material, first of all, is important. Besides that, a condition under which the ink is spouted and a condition under the ink is charged are important. Specifically, these conditions include an ink viscosity, an excitation frequency, an excitation voltage, and a discharge pressure. In addition, optimal conditions of them change depending on an operating environment such as a temperature and a humidity, and even on a deterioration state of the ink.

So far, optimal printing conditions could not be controlled in real time while the charge control-type inkjet printer is in operation and have been managed based on a relationship between a temperature and a viscosity by software that was created earlier. Therefore, when the printer is operated in an unpredicted environment, the software cannot follow up, resulting in a poor printing.

Further, when designing an ink including the aforementioned resin, coloring agent, additive (conductive material, leveling agent and the like) and solvent, there is a problem in which printing conditions (ink viscosity, excitation frequency, excitation voltage, discharge pressure, etc.) need to be individually set and examined without being determined based on a particle shape unconditionally, which takes time.

The present invention provides a charge control-type inkjet printer and a printing method using the same which is capable of solving the above-mentioned problem to enable real-time control during an operation of the charge control-type inkjet printer and maintaining optimal printing conditions while the charge control-type inkjet printer is in operation.

Solutions to Problems

In order to solve the above-mentioned problems, according to the present invention, there is provided a charge control-type inkjet printer which includes a printing head including a nozzle unit that discharges ink, a pressure reduction valve that adjusts a pressure of the ink supplied to the nozzle unit of the printing head, and an ink container that accommodates the ink to be supplied to the nozzle unit of the printing head, and the charge control-type inkjet printer further includes an imaging unit that images the ink discharged from the nozzle unit being in a particulate state.

In addition, in order to solve the above-described problems, the present invention provides a printing method using a charge control-type inkjet printer where the ink accommodated in an ink container is spouted as the particle from a nozzle unit of a printing head via a pressure reduction valve to be printed on a printing target. In the printing method, printing is performed while acquiring an image of the ink spouted from the nozzle unit and being in a particulate state by imaging the ink spouted from the nozzle unit and being in a particulate state with a camera.

Effects of the Invention

According to the present invention, it is possible to determine whether the shape of the ink particle is optimal during printing in the charge control-type inkjet printer, and it is possible to print in a stable state all the time by controlling the shape of the ink particle to be optimal.

BRIEF DESCRIPTION OF THE DRAWINGS

FIG. 9 is a table stored in a database illustrating a relationship between a difference between a reference value and a feature amount of an ink particle image acquired by a particle observation unit of a charge control-type inkjet printer in an embodiment of the present invention and a control region and a control amount of the apparatus.

MODE FOR CARRYING OUT THE INVENTION

The present application is a charge control-type inkjet printer which is capable of observing a shape of an ink particle in real time, estimating an electrification property, and controlling under a printing condition which is optimal in all conditions.

Features of the present invention include:

(1) an adjustment mechanism of observing shapes of an ink column and ink particles coming out from a discharge port and mainly adjusting an excitation frequency, an excitation voltage, and an ink pressure with a fluid control unit so that the observed shape becomes an optimal shape, when performing printing with a charge control-type inkjet printer, (2) a mechanism of recognizing whether an optimal particle shape matches optimal shape data of the ink column and the ink particles in the charge control-type inkjet printer including the adjustment mechanism, (3) a mechanism for verifying whether or not charged state is suitable by measuring electric charge is provided in the charge control-type inkjet printer including a charge state observation unit, in addition to the above features (1) and (2), (4) in addition, a mechanism capable of accumulating image data of a newly acquired particle shape and charged state measurement data and verifying a correlation between both data is provided in the charge control-type inkjet printer.

Hereinafter, embodiments of the present invention will be described with reference to the drawings.

Figure 1:
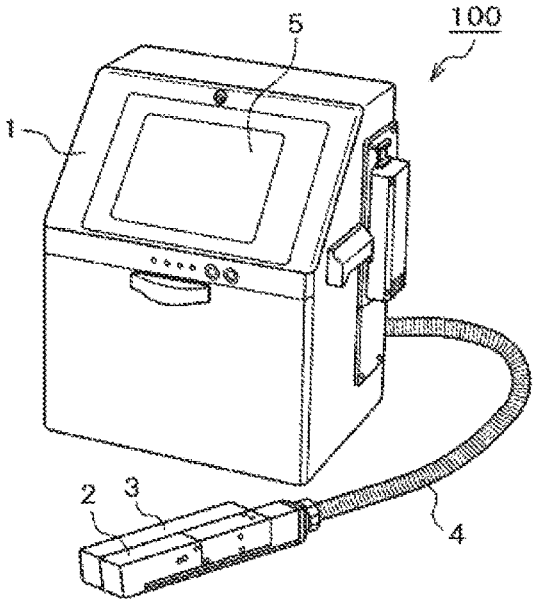
FIG. 1 is a perspective view illustrating a configuration of a charge control-type inkjet printer according to an embodiment of the present invention.

FIG. 1 is a perspective view illustrating a charge control-type inkjet printer 100 according to the present embodiment. The charge control-type inkjet printer 100 includes a main body 1 including an operation display unit 5, a printing head 2, and a detection unit 3. The main body 1 and the printing head 2 are connected by a conduit 4.

Figure 2:
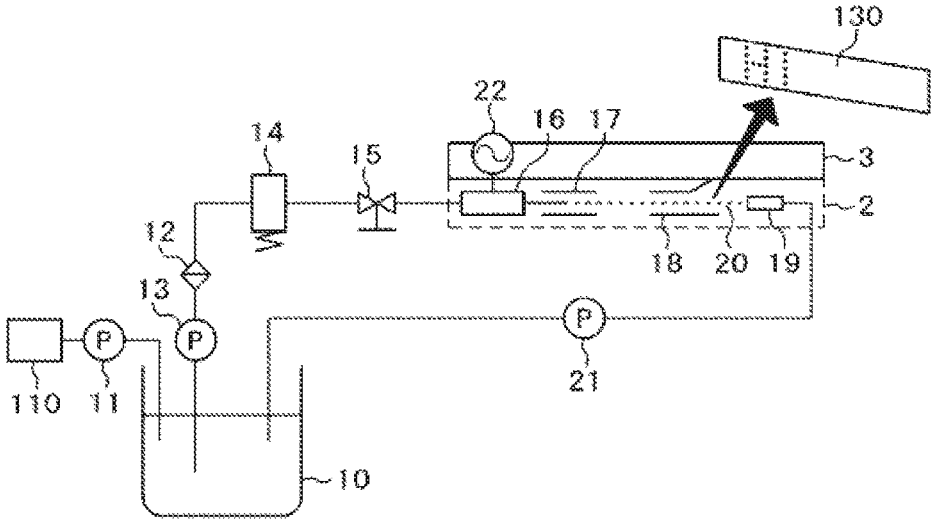
FIG. 2 is a block diagram illustrating a schematic configuration of an ink circulation system of a charge control-type inkjet printer according to an embodiment of the present invention.

Further, FIG. 2 illustrates a simplified ink circulation system of the charge control-type inkjet printer 100 according to the present embodiment. An ink container 10 stored in the main body 1 of the charge control-type inkjet printer 100 stores ink, and the ink is sucked out from the ink container 10 by the pump 13 and is pressure-fed to the printing head 2 through the conduit 4. The pressure-fed ink is filtered by a filter 12 and adjusted to a predetermined pressure by a pressure reduction valve 14.

Viscosity of the ink sucked out from the ink container 10 by the pump 13 is measured with a viscometer (not shown), and a solvent is sucked out from a solvent tank 110 by a pump 11 so that the viscosity of the ink is maintained constant and is supplied to the ink container 10.

The filter 12 and the pressure reduction valve 14 may be provided in the main body 1 or on the side of the printing head 2.

When a valve 15 provided in a conduit of the circulation system is opened, the ink is delivered to a nozzle 16 of the printing head 2 and ejected from an orifice (not shown) which is a discharge port of the nozzle 16.

The printing head 2 includes a nozzle 16, a charging electrode 17, a deflection electrode 18 formed by disposing a pair of electrode plates facing each other, and a gutter 19 for collecting ink particles not contributing to printing, and is controlled by a control unit 30 on the side of the main body 1. In addition, a detection unit 3 is attached to the printing head 2.

The nozzle 16 is connected to an excitation unit 22. The excitation unit 22 applies a predetermined excitation voltage to a piezoelectric element 23 (see FIG. 3) attached to the nozzle 16, and vibrates the piezoelectric element 23 attached to the nozzle 16 at a predetermined frequency.

The ink adjusted to a predetermined pressure by the pressure reduction valve 14 is supplied to the printing head 2 and is spouted as an ink column from the nozzle 16. At this time, the piezoelectric element 23 attached to the nozzle 16 is driven by the excitation unit 22 to vibrate at a predetermined frequency, the vibration is transmitted to the nozzle 16, and the excited ink is spouted from the nozzle 16. The columnar ink (ink column) spouted from the nozzle 16 in the excited state is separated into particles at a point apart by a predetermined distance from an outlet of the nozzle 16 to become ink particles 20. The state in which particles are formed from the columnar ink (ink column) to become the ink particles 20 is observed and controlled by the control unit 30.

When the ink particles 20 are separated from the columnar ink while passing between a pair of charging electrodes 17 constituting a charging part, the ink particles 20 are charged by the charging electrode 17 constituted by arranging a pair of electrode plates to face each other such that each of the ink particles 20 has a controlled charge amount.

A charging circuit (not shown) for controlling the charging electrode 17 changes a charging voltage of the charging electrode 17 according to a size of a symbol such as a character or a bar code to be printed on a printing object 130, and changes the charging amount of the ink particles 20.

The ink particles 20 charged while passing between the pair of electrode plates of the charging electrode 17 reaches a space between the pair of electrode plates forming the deflection electrode 18 with a momentum spouted from the nozzle 16.

One of the two electrode plates constituting the deflection electrode 18 is grounded, and the other is supplied with a high voltage. Thus, an electrostatic field is formed between the electrodes. The ink particles 20 charged to a predetermined charge by the charging electrode 17 which has reached the space between the pair of electrode plates forming the deflection electrode 18 are deflected according to their charge amount.

The ink particles 20 deflected by the deflection electrode 18 jump out from the printing head 2, and land on the printing object 130 moving away from the printing head 2 by a predetermined distance.

Although the ink particles 20 landed on the printing object 130 are points, a plurality of points gather to form a character symbol.

The ink particles 20 not used for printing are captured by a gutter 19 provided inside the printing head 2. The captured ink particles 20 are sucked by a recovery pump 21 and returned to the ink container 10 through an ink recovery pipe of the ink circulation system.

Figure 3:
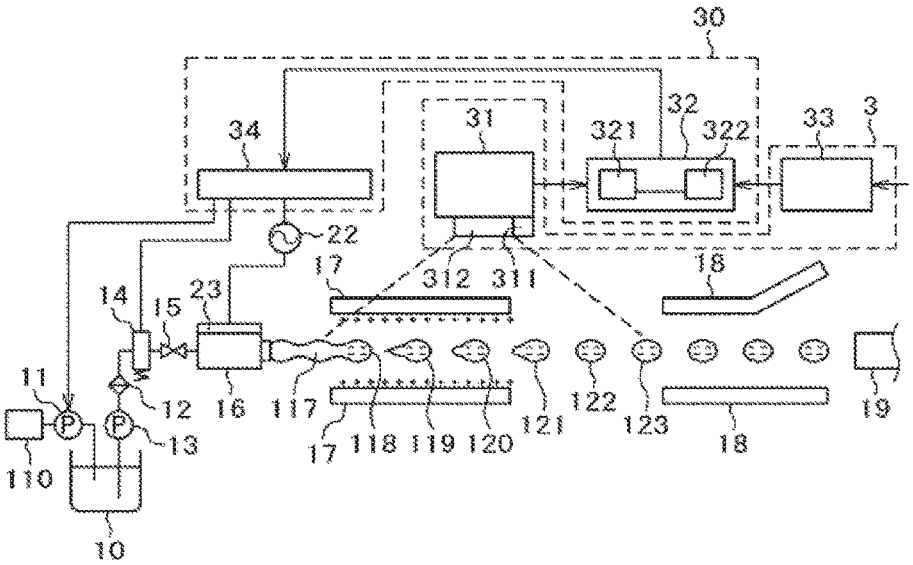
FIG. 3 is a block diagram schematically illustrating a detailed configuration of a printing head unit, a detection unit, and a control unit of a charge control-type inkjet printer according to an embodiment of the present invention, and a state in which ink is made into particles in the printing head unit.

Next, FIG. 3 illustrates a schematic configuration of a charge control-type inkjet printer 100 having a function of adjusting so as to achieve an optimal particle shape according to the present embodiment.

FIG. 3 schematically illustrates a configuration of the control unit 30 and a state in which the ink column 117 spouted from the nozzle 16 is made into particles, in addition to a detailed configuration of the detection unit 3 described with reference to FIG. 2. The same components as those described in FIG. 2 are denoted by the same reference numerals.

The detection unit 3 includes a particle observation unit 31 and a charge amount observation unit 33. The control unit 30 includes a control unit 32 and a fluid control unit 34. The particle observation unit 31 and the charge amount observation unit 33 constituting the detection unit 3 are attached to the printing head 2.

The particle observation unit 31 includes a stroboscope 311 and a camera 312, and illuminates the ink column 117 spouted from the nozzle 16 by the stroboscope 311. In such an illumination (stroboscopic illumination) by the stroboscope 311, a frequency of the stroboscopic illumination is adjusted so that the ink spouted from the nozzle 16 is stopped and observed. The ink spouted from the nozzle 16 adjusted in the manner described above and illuminated by the stroboscopic illumination is imaged by enlarging a field of view of the camera 312 to such an extent that shapes of a plurality of ink particles can be sufficiently discriminated by the camera 312 or that several ink particles illuminated by the stroboscopic illumination enter the field of view of the camera 312.

For the sake of explanation, FIG. 3 illustrates a configuration in which the particle observation unit 31 is disposed on the charging electrode 17 and the ink spouted from the nozzle 16 is imaged by the camera 312 from an upper side of the charging electrode 17. However, in practice, the particle observation unit 31 is disposed at a position where the field of view is not blocked by a pair of electrode plates of the charging electrode 17 in a direction rotated by 90 degrees with respect to the charging electrode 17, that is, in a lateral direction of the charging electrode 17, and images the ink particles passing through the charging electrode 17.

The ink illuminated with the stroboscope and imaged by the camera 312 is observed to have such a shape that, immediately after a tip portion 118 is separated into 119, 120, 121, 122 and 123 from the state of the ink column 117 immediately after being spouted, a tailed elongated shape (119) gradually changes to a round particle shape (123). Image data of the shapes of the ink particles 119 to 123 observed by the camera 312 of the particle observation unit 31 is sent from the particle observation unit 31 to the control unit 32.

The control unit 32 includes an image processing unit 321 and a mechanism control unit 322. The image processing unit 321 compares image data of the shapes of the ink particles 119 to 123 imaged by the camera 312 with reference image data stored in advance to extract a difference between the observed shapes of the ink particles 119 to 123 and reference shape data at respective positions. The mechanism control unit 322 controls the fluid control unit 34 so that the difference extracted by the image processing unit 321 becomes small.

Based on the control signal output from the control unit 32, the fluid control unit 34 controls a voltage applied to the excitation unit 22 that controls an amplitude of vibration of the piezoelectric element 23 (not shown) that applies ultrasonic vibration to the nozzle 16, a pressure of the pressure reduction valve 14 that adjusts a pressure of the ink supplied to the nozzle 16, and a supply amount of the solvent that dissolves the ink stored in the solvent tank 110 to the ink container 10 by the pump 11.

The ink whose pressure is adjusted by the pressure reduction valve 14 is discharged from the nozzle 16 ultrasonically vibrated by the piezoelectric element 23 driven by the excitation unit 22 to become the ink column 117. Then, the tip portion 118 of the ink column 117 changes into the ink particles 119 and then deformed into the ink particles 120, 121 and 122 gradually to become a charged ink particle 123. This charging is performed by passing between the pair of electrode plates on which an electric field of the charging electrode 17 is formed.

The ink particles 123 charged by passing through the charging electrode 17 are deflected by the electric field formed by the deflection electrode 18 formed by a pair of electrode plates.

In this case, it was found that a chargeability of the ink particle 123 depends on the shape of the ink particle 123, particularly, the shape when the tip portion 118 of the ink column 117 changes to the ink particle 119.

Therefore, it is possible to examine (predict) the chargeability of the ink particles by observing the shape at this time, that is, the shape when the tip portion 118 of the ink column 117 changes to the ink particle 119 with the use of the particle observation unit 31.

As described above, the shapes of the ink particles 119 to 123 formed by the ink discharged from the nozzles 16 may be changed by adjusting the excitation frequency and the excitation voltage of the excitation unit 22 and a pressure-feeding power (an ink pressure) by the pressure reduction valve 14 with the use of the fluid control unit 34 controlled by the control unit 32.

In view of this, in the present embodiment, the particle observation unit 31 observes the shape of the ink particle immediately after spouted from the nozzle 16 until it enters the deflection electrode 18, and the control unit 32 controls the fluid control unit 34 such that the shape conforms to an optimal particle shape for each position input in advance. As a result, printing can be stably performed even under operation conditions of various charge control-type inkjet printers.

The chargeability is checked by checking a charge amount of the ink particles recovered by the gutter 19, which is an ink particle recovery unit, with the use of the charge amount observation unit 33. At this time, if a voltage is applied to the deflection electrode 18, the charged ink particle 123 is deflected. For this reason, no voltage is applied to the deflection electrode 18.

Further, a relationship between the image data imaged by the camera 312 of the particle observation unit 31 and the charge amount measured by the charge amount observation unit 33 is stored as data and fed back to the control unit 32.

Figure 4:
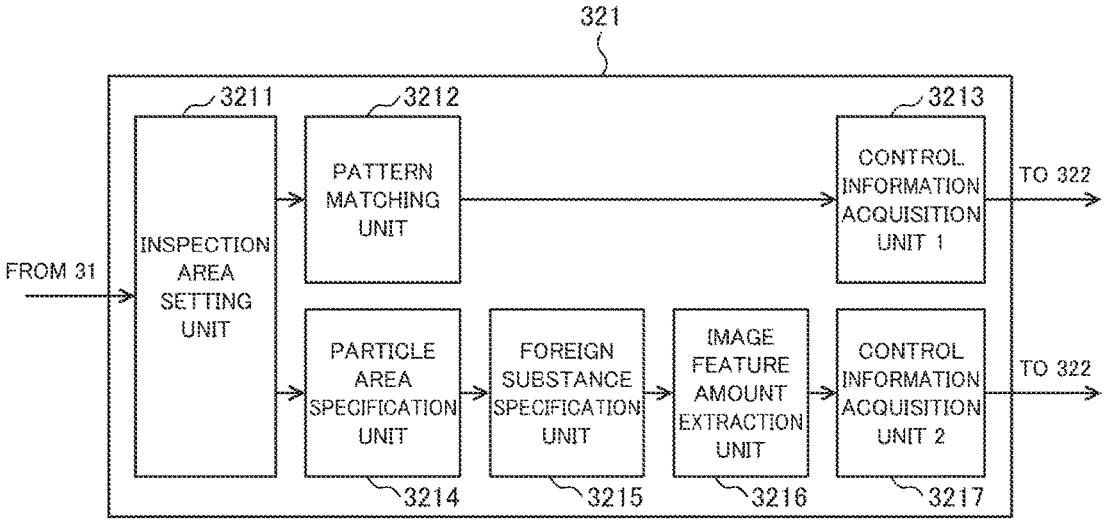
FIG. 4 is a block diagram illustrating a configuration of an image processing unit of a charge control-type inkjet printer according to an embodiment of the present invention.

Next, a configuration of the image processing unit 321 of the control unit 32 is illustrated in FIG. 4. The image processing unit 321 includes an inspection area setting unit 3211 for setting an inspection area from the image imaged by the camera 312 of the particle observation unit 31, a pattern matching unit 3212 that performs a pattern matching of images of ink particles in an area set by the inspection area setting unit 3211 to images stored in advance to extract images similar to the images of the ink particles, and a control information acquisition unit 1:3213 for acquiring information to be controlled by the mechanism control unit 322 from information of the images of the ink particles stored in advance which is extracted by the pattern matching unit 3212.

Further, the image processing unit 321 includes a particle area specifying unit 3214 for specifying a region of ink particles within the area set by the inspection area setting unit 3211, a foreign substance determination unit 3215 for determining whether foreign matter is contained in the ink particle area specified by the particle area specifying unit 3214, an image feature amount extraction unit 3216 for extracting an image feature amount of the ink particles from the images of the ink particles determined to include no foreign matter by the foreign substance determination unit 3215, and a control information acquisition unit 2:3217 for acquiring information to be controlled by the mechanism control unit 322 from the image feature amount of the ink particle extracted by the image feature amount extraction unit 3216.

Figure 5:
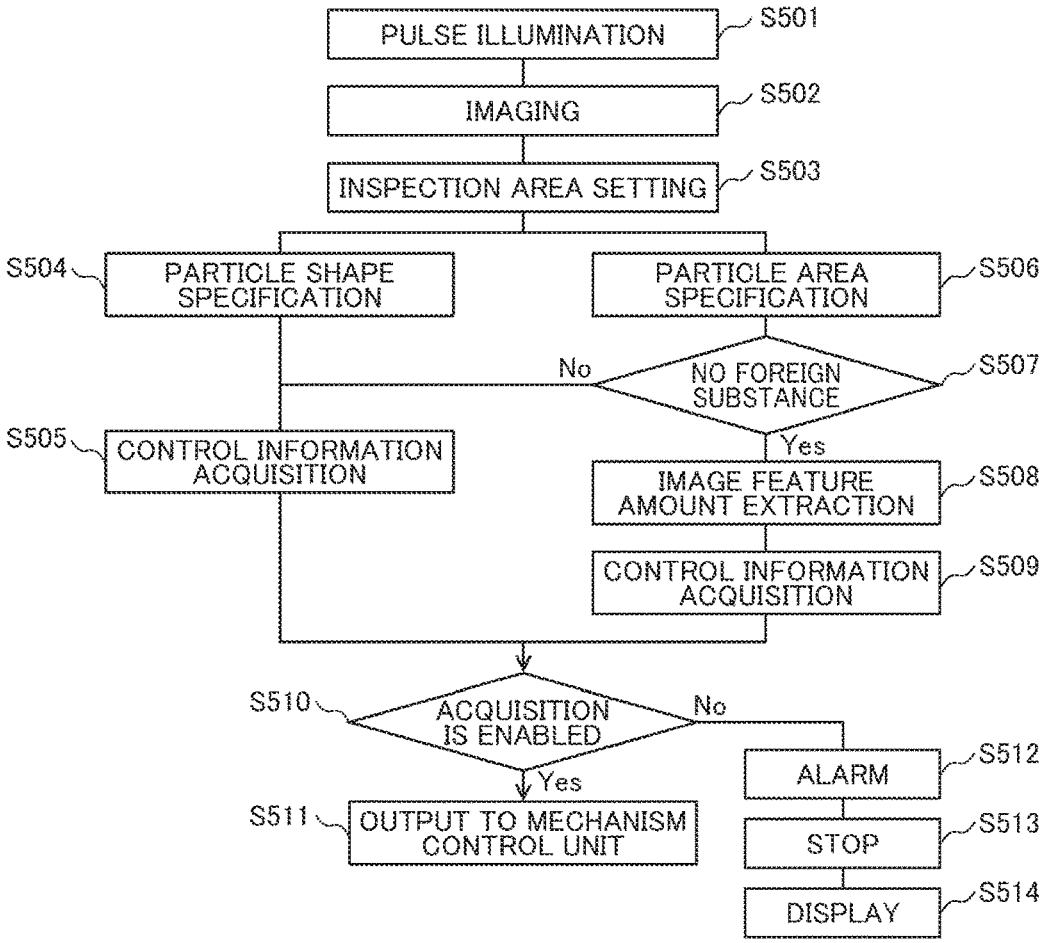
FIG. 5 is a flowchart illustrating a flow of processing in an image processing unit of a charge control-type inkjet printer in an embodiment of the present invention.

Next, a process flow of an ink particle shape control method in present embodiment will be described with reference to the flow chart of FIG. 5.

First, a stroboscopic light is irradiated from the stroboscope 311 to the ink spouted from the nozzle 16 in a state where the piezoelectric element 23 is driven by the excitation unit 22 under an initial setting condition and the nozzle 16 is vibrated at high frequency (S 501). At this time, an emission frequency of the stroboscopic light is adjusted so that the ink particles irradiated with the stroboscopic light are observed to be stationary.

In this way, the camera 312 of the particle observation unit 31 images the ink particles which are irradiated with the stroboscopic light and observed to be stationary (S502), and acquires images of the ink particles. The images of the ink particles imaged and acquired by the camera 312 are sent from the particle observation unit 31 to the control unit 32, and input to the image processing unit 321.

Figure 6:
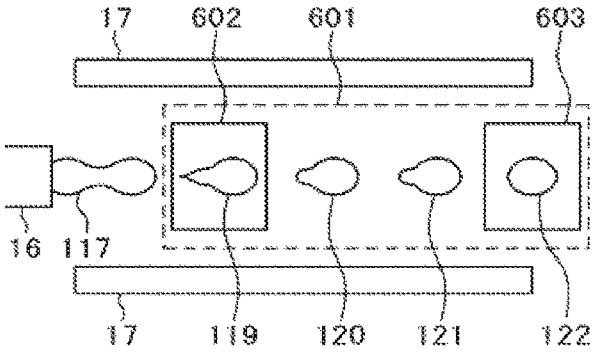
FIG. 6 is an image illustrating both inspection machines in an image acquired by a particle observation unit of a charge control-type inkjet printer in an embodiment of the present invention.

The images input to the image processing unit 321 are binarized by the inspection area setting unit 3211, and then an inspection area 601 is set as illustrated in FIG. 6 (S503).

Subsequently, a region 602 including the ink particles in the left end of the inspection area 601, that is, a region 602 including an image of the ink particle which is observed first is extracted, and an image that most closely matches the image of the region 602 is selected from images of the ink particles whose relationship between shapes of the ink particles stored in advance by a pattern matching and control information by the mechanism control unit is known, thus specifying the shape of the particle (S504). For example, as illustrated in a table 701 of FIG. 7, the image whose shape is known may include images obtained by classifying the ink particles for classifying the images acquired by the particle observation unit and stored in a database, as A, B, C and D.

Next, control information by the mechanism control unit is acquired from a relationship between the shapes of the ink particles stored in advance and the control information by the mechanism control unit (S505). Here, the relationship between the shapes of the ink particles stored in advance and the control information by the mechanism control unit may include a relationship between a result of classifying the images acquired by the particle observation unit and stored in a database and a control region and a control amount of the apparatus, as illustrated in a table 801 of FIG. 8.

Figures 7, 8:
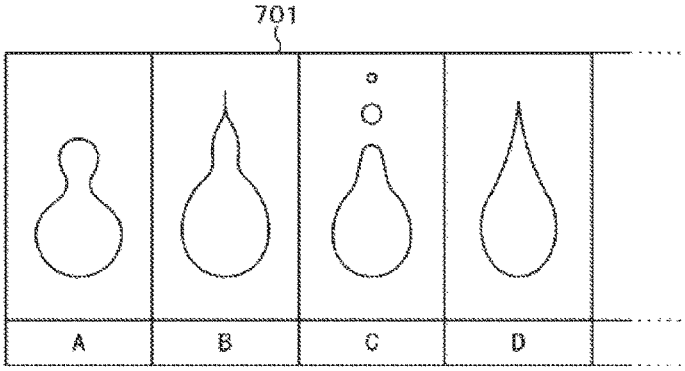
FIG. 7 is a table showing a list of images of ink particles stored in a database for classifying images acquired by a particle observation unit of a charge control-type inkjet printer according to an embodiment of the present invention.
FIG. 8 is a table stored in a database illustrating a relationship between a result of classifying images acquired by a particle observation unit of a charge control-type inkjet printer and a control region and a control amount of the apparatus according to an embodiment of the present invention.

For example, if the image of the ink particle is determined to closest to the shape A in FIG. 7 as a result of the pattern matching in S504, it is determined from the table of FIG. 8 that there is no place to be controlled by a storage control unit and the current status is okay, as it is, in S505. On the other hand, if it is determined in S504 that the image of the ink particle is closest to the shape B in FIG. 7, a control command is selected from the table of FIG. 8 so as to control an ink viscosity adjustment mechanism to adjust the viscosity of the ink to be decreased in S505.

On the other hand, a particle region is specified from the image of the inspection area 601 set in S503 (S506). In the image illustrated in FIG. 6, an image 603 of a small area including the fourth particle from the right side in the image of the inspection area 601 is specified.

Subsequently, it is checked whether foreign matter such as minute ink particles is included in an image of the small area specified in S506 (S507). As a result of the check, if it is determined that a foreign object is included in the image (in the case of NO), the process proceeds to S505, where the control information by the mechanism control unit is selected from the ink particle image information stored in the database.

On the other hand, if it is determined in S507 that foreign matter is not included in the image (in the case of YES), the feature amount of the image of the ink particle in the particle region specified in S506 is extracted (S508). Here, the feature amount of the image of the ink particle to be extracted may include dimensions in the X direction or the Y direction of the image of the ink particle, a ratio between the dimension in the X direction and the dimension in the Y direction, and the like.

Subsequently, the feature amount of the image of the ink particle extracted in S508 is compared with a feature amount of a reference image data, and control information of a mechanism unit is acquired from a relationship between an image feature amount difference value obtained by storing a difference value between the feature amount of the image of the extracted ink particle and the feature amount of the reference image data in the database and a mechanism unit control amount is obtained (S509). An example of the relationship between the image feature amount difference value stored in the database and the mechanism unit control amount may be summarized by a relationship between a result of classifying the images acquired by the particle observation unit and stored in a database and a control region and a control amount of the apparatus, as illustrated in a table 901 of FIG. 9.

Whether the control information is acquired in S505 and whether the control information is acquired in S509 are determined (S510). If both are YES (when the particle shape and the image feature amount difference value are within ranges stored in the database), the respective control information are output to the mechanism control unit 322 (S511).

The mechanism control unit 322 that has input the control information from the image processing unit 321 in step S511 sends a control signal based on the input control information to the fluid control unit 34, and adjusts an excitation frequency or an excitation voltage of the excitation unit 22, an ink pressure by the pressure reduction valve 14, and viscosity of the ink by driving the pump 11 to supply the solvent from the solvent tank 110 to the ink container 10.

On the other hand, if it is determined as NO in S511 (when control information cannot be acquired in at least one of S505 and S509), a warning is issued (S512) to stop the printing (S513), and the information determined as NO is displayed on a screen of the operation display unit 5 of the main body 1 (S514).

According to the present embodiment, it is possible to quantitatively monitor the shape of the ink particle immediately after being spouted from the nozzle 16 while printing and adjust each mechanism unit, thus performing the printing continuously with a constant quality maintained. In addition, since the shape of the ink particle immediately after being spouted from the nozzle 16 is monitored quantitatively, even if an ink material changes, it is possible to continue printing while maintaining a constant printing quality without taking much time for adjustment.

REFERENCE SIGNS LIST

1: main body, 2: printing head, 3: detection unit, 4: conduit, 10: ink container, 14: pressure reduction valve, 16: nozzle, 17: charging electrode, 18: deflection electrode, 19: gutter, 22: excitation unit, 30: control unit, 31: particle observation unit, 32: control unit, 321: image processing unit, 322: mechanism control unit, 33: charge amount observation unit, 34: fluid control unit, 100: charge control-type inkjet printer.

The invention claimed is:

1. A charge control-type inkjet printer, comprising:

a printing head including a nozzle unit for discharging ink;

a pressure reduction valve that adjusts a pressure of ink to be supplied to a nozzle unit of the printing head;

an ink container for containing ink to be supplied to the nozzle unit of the printing head;

an imaging unit that images the ink discharged from the nozzle unit and being in a particulate state; and an image processing unit that processes an image of the ink discharged from the nozzle unit and being in a particulate state, the image of the ink being obtained by the imaging unit;

wherein said imaging processing unit compares image data of ink being in a particulate state processed by said image processing unit with reference image data of the ink being in a particulate state to extract a difference between them.

2. The charge control-type inkjet printer according to claim 1, wherein the imaging unit includes a stroboscopic light emitting unit that issues a stroboscopic light, and wherein the imaging unit images an enlarged image of the ink being in a particulate state by irradiating the ink discharged from the nozzle unit and being in a particulate state with a stroboscopic light issued from the stroboscopic light emitting unit.

3. The charge control-type inkjet printer according to claim 1, further comprising a control unit that controls a viscosity, an excitation frequency, an excitation voltage, and a discharge pressure of the ink in the nozzle unit, the pressure reduction valve, and the ink container based on a result of processing by the image processing unit.

4. A charge control-type inkjet printer, comprising:

a printing head including a nozzle unit for discharging ink;

a pressure reduction valve that adjusts a pressure of ink to be supplied to a nozzle unit of the printing head;

an ink container for containing ink to be supplied to the nozzle unit of the printing head;

an image processing unit that processes an image of the ink discharged from the nozzle unit and being in a particulate state, the image of the ink being obtained by imaging;

wherein the charge control-type inkjet printer further comprises an imaging unit that images the ink discharged from the nozzle unit and being in a particulate state; and wherein the image processing unit compares the image of the ink discharged from the nozzle unit and being in a particulate state, the image of the ink being obtained by imaging by the imaging unit, and an image stored in advance and outputs abnormality information when detecting an abnormality in the particulate state.

5. A printing method using a charge control-type inkjet printer where an ink accommodated in an ink container is spouted from a nozzle unit of a printing head via a pressure reduction valve to be printed on a printing target and is in a particulate state, wherein printing is performed while acquiring an image of the ink spouted from the nozzle unit and being in a particulate state by imaging the ink spouted from the nozzle unit and being in a particulate state with a camera, wherein an image processing unit processes an image of the ink discharged from the nozzle unit and being in a particulate state, the image of the ink being obtained by the camera, and wherein said imaging processing unit compares image data of ink being in a particulate state processed by said image processing unit with reference image data of the ink being in a particulate state to extract a difference between them.

6. The printing method using the charge control-type inkjet printer according to claim 5, wherein an image including the image of the ink before being discharged from the nozzle unit and being in a particulate state and an image after being discharged from the nozzle unit and being in a particulate state is obtained as an image of the ink.

7. The printing method using the charge control-type inkjet printer according to claim 5, wherein an enlarged image of the ink discharged from the nozzle unit and being in a particulate state is obtained by irradiating the ink being in a particulate state with a stroboscopic light.

8. The printing method using the charge control-type inkjet printer according to claim 5, wherein shape information of the ink discharged from the nozzle unit and being in a particulate state is obtained by processing the image of the ink discharged from the nozzle unit and being in a particulate state, the image of the ink being obtained by the imaging.

9. The printing method using the charge control-type inkjet printer according to claim 8, wherein, based on a result of processing the image, printing is performed on a printing target while any one of the nozzle unit, the pressure reduction valve, and a concentration of the ink in the ink container is controlled.

10. The charge control-type inkjet printer according to claim 1, wherein said imaging processing unit processes the image of the ink to examine a chargeability of the ink in a particulate state.

11. The charge control-type inkjet printer according to claim 10, wherein said imaging processing unit processes the image of the ink when a tip portion of the ink column changes to the ink in a particulate state.

12. The charge control-type inkjet printer according to claim 3, wherein said control unit controls a viscosity, an excitation frequency, an excitation voltage, and a discharge pressure of the ink in the nozzle unit based on a result of processing by the image processing unit so that the difference extracted by the image processing unit becomes small.

* * * * *